United States Patent [19]

Marten

[11] Patent Number: 4,963,513

[45] Date of Patent: Oct. 16, 1990

[54] COAL GASIFICATION COGENERATION PROCESS

[75] Inventor: Jerome H. Marten, Baton Rouge, La.

[73] Assignee: Florida Institute of Phosphate Research, Lakeland, Fla.

[21] Appl. No.: 356,752

[22] Filed: May 24, 1989

[51] Int. Cl.[5] ..... C01J 3/14; C01J 3/16; C01J 3/84; C01B 17/50

[52] U.S. Cl. ..... 48/210; 48/203; 423/168; 423/171; 423/172; 423/541 R; 423/542; 423/555

[58] Field of Search ..... 48/197 R, 202, 206, 48/210, 203, 209; 420/541 R, 168, 171, 172, 542, 555

[56] References Cited

U.S. PATENT DOCUMENTS

| | | | |
|---|---|---|---|
| 2,649,166 | 8/1953 | Porter et al. . | |
| 3,169,269 | 2/1965 | McDowell et al. . | |
| 3,302,936 | 2/1967 | Ban . | |
| 3,325,395 | 6/1967 | Ban . | |
| 3,592,602 | 7/1971 | Palm . | |
| 3,798,308 | 3/1974 | Tatterson . | |
| 3,932,595 | 1/1976 | Berthoux et al. . | |
| 4,017,272 | 4/1977 | Anwer et al. . | |
| 4,080,424 | 3/1978 | Miller et al. . | |
| 4,082,519 | 4/1978 | Steiner | 48/202 |
| 4,093,701 | 6/1978 | Butwell . | |
| 4,111,755 | 9/1978 | Ban . | |
| 4,200,517 | 4/1980 | Chalmers et al. . | |
| 4,207,304 | 6/1980 | Beavon . | |
| 4,220,454 | 9/1980 | Ban et al. . | |
| 4,235,605 | 11/1980 | Kim | 48/202 |
| 4,302,218 | 11/1981 | Friedman . | |
| 4,341,753 | 7/1982 | Mori et al. . | |
| 4,503,018 | 3/1985 | Gardner et al. . | |
| 4,744,969 | 5/1988 | Marten et al. . | |
| 4,769,045 | 9/1988 | Grindley | 48/202 |
| 4,786,291 | 11/1988 | Wilson | 48/202 |

OTHER PUBLICATIONS

Patel, "Clean Fuel From Coal is Goal of U-Gas Process", Aug. 1977, The Oil and Gas Journal, pp. 51–54.

*Primary Examiner*—Peter Kratz
*Attorney, Agent, or Firm*—Bernard, Rothwell & Brown

[57] ABSTRACT

The present invention relates to the coproduction of a combustible gas stream usable as an energy source, a sulfur-dioxide-containing second gas stream usable as a source of oxidant in the gasification of coal, and a sulfur-dioxide-containing third gas stream usable as a feedstock for the production of sulfuric acid. The process includes heating coal in a coal gasification zone in the presence of an oxygen and sulfur dioxide-containing atmosphere under partial coal gasifying conditions to produce a carbonaceous char and a crude coal gas stream. Sulfur-containing compounds are removed from the coal gas stream and converted to elemental sulfur. The carbonaceous char is combined with gypsum to form a feed mixture. The non-gypsum portion of the feed mixture contains sufficient reducing potential to release substantially all of the sulfur in the gypsum as gaseous compounds of sulfur in a +4 or lower oxidation state. The feed mixture is heated under reducing conditions to produce a sulfur-dioxide-containing second gas stream recovered at an early statge of the reaction a sulfur-dioxide-containing third gas stream and a solid sintered product. The sulfur-dioxide-containing second gas stream is recycled back to the gasification zone to provide th eoxidant for the coal gasification.

31 Claims, 3 Drawing Sheets

COAL GASIFICATION COGENERATION PROCESS

FIELD OF THE INVENTION

The present invention relates to the conversion of relatively low-value coal and gypsum to valuable gas streams and solid products, particularly, to the utilization of high-sulfur-content coal and phosphogypsum to produce elemental sulfur, sulfuric acid and a solid aggregate.

BACKGROUND OF THE INVENTION

Natural phosphate rock, particularly the mineral, apatite (calcium phosphate), is a primary commercial source of phosphorous. One of the most common methods of producing phosphoric acid from phosphate rock is the acid or wet process. The wet process comprises reacting refined phosphate rock with sulfuric acid to produce phosphoric acid and an impure calcium sulfate, known as phosphogypsum. Phosphogypsum has, until recently, been considered a waste product of the wet process, having no commercial value. Thus, great mounds of phosphogypsum have accumulated near and around phosphoric acid plants. These mounds of phosphogypsum pose an environmental problem due mainly to the acidification of rainwater and subsequent runoff of the soluble compounds from the phosphogypsum.

One commercially valuable process for the conversion of phosphogypsum into useful products is disclosed in U.S. Pat. No. 4,503,018 issued to Gardner et al. ("Gardner"), which is incorporated herein by reference in its entirety The Gardner process yields a sulfur-containing gas stream resulting from the thermal decomposition of the gypsum. More specifically, the Gardner process involves charging a pelletized mixture of carbonaceous material and gypsum to a travelling grate where the mixture is dried and sintered to produce a gaseous effluent containing sulfur dioxide and/or sulfur. After the pellets have undergone thermal decomposition, the lime residue may be sold or used in conventional applications.

U.S. Pat. No. 4,744,969, which is incorporated herein by reference in its entirety, describes another process for the conversion of phosphogypsum into useful products. This described process simultaneously converts high-sulfur, low-BTU coal and gypsum into sulfur-free and sulfur-rich gas streams along with a solid aggregate. The coal is gasified producing char and sulfur-containing gas from which sulfur is removed, leaving a substantially sulfur-free gas stream, and the sulfur is converted into solid sulfur compounds. These solid sulfur compounds along with the char and the gypsum are fed to a desulfurization reactor. The desulfurization reactor has predrying, drying, firing and cooling stages which convert the char and gypsum into the desired products.

Because of the rapid rate at which gypsum is produced in phosphoric acid plants, and the large stockpiles of this material which presently exist, there is a continuing need for more efficient gypsum-converting processes. If existing processing technology were employed for consuming all of the phosphogypsum produced, such would result in the production of excess sulfuric acid.

SUMMARY OF THE INVENTION

The present invention relates to a process for the coproduction of a combustible, substantially sulfur-free, first gas stream usable as an energy source, a sulfur-dioxide-containing second gas stream usable as a source of oxidant in the gasification of coal, and a sulfur-dioxide-containing third gas stream usable as a feedstock for the production of sulfuric acid. The process includes reacting coal in a coal gasification zone in the presence of an oxygen and sulfur-dioxide-containing atmosphere under partial coal-gasifying conditions to produce carbonaceous char and a crude coal gas stream. Sulfur-containing compounds are separated from the crude coal gas stream to produce a combustible first gas stream and elemental sulfur in a sulfur recovery zone. The carbonaceous char and gypsum plus other ingredients may be combined to form a feed mixture The non-gypsum portion of the carbonaceous char and gypsum contains sufficient reducing potential to reduce the sulfur in the gypsum to gaseous compounds of sulfur in a +4 or lower oxidation state. The feed mixture is heated, such as by combustion of a portion of the combustible first gas stream, to reduce the sulfur compounds in the mixture to gaseous compounds of sulfur in a +4 or lower oxidation state, which are suitable for utilization in the manufacture of sulfuric acid. The carbonaceous char and gypsum are reacted in a reaction zone under reducing conditions to produce first a sulfur-dioxide-containing second gas stream which contains weaker $SO_2$, which is removed from the reaction zone. Then a sulfur-dioxide-containing third gas stream which contains concentrated $SO_2$ is recovered from a later stage in the reaction zone and utilized to produce sulfuric acid. The sulfur-dioxide-containing second gas stream can be advantageously recycled back to the coal gasification zone where it can be mixed with air to provide the oxygen-equivalent required for the coal gasification. The process also yields a solid sintered product having value as, e.g., an aggregate for paving mixtures.

The process is particularly useful for efficiently converting low-value products, such as high-sulfur, low-BTU coal and phosphogypsum to valuable products, including sulfuric acid, elemental sulfur and a quality aggregate material, with a net export of energy. The process is thus highly advantageous from the environmental standpoint, in that it utilizes phosphogypsum, an environmental pollutant, and from an energy standpoint, in that relatively low-quality coal can be converted to a clean combustible gas and a carbon source for the gypsum desulfurization reactor.

The process of the present invention also presents a great advantage over other processes for consuming phosphogypsum since all of the phosphogypsum produced in a phosphoric acid plant may by consumed without producing an excess of sulfuric acid. Instead, the excess sulfur is recovered as elemental sulfur, a more valuable product.

DETAILED DESCRIPTION OF THE INVENTION

Figure 1:
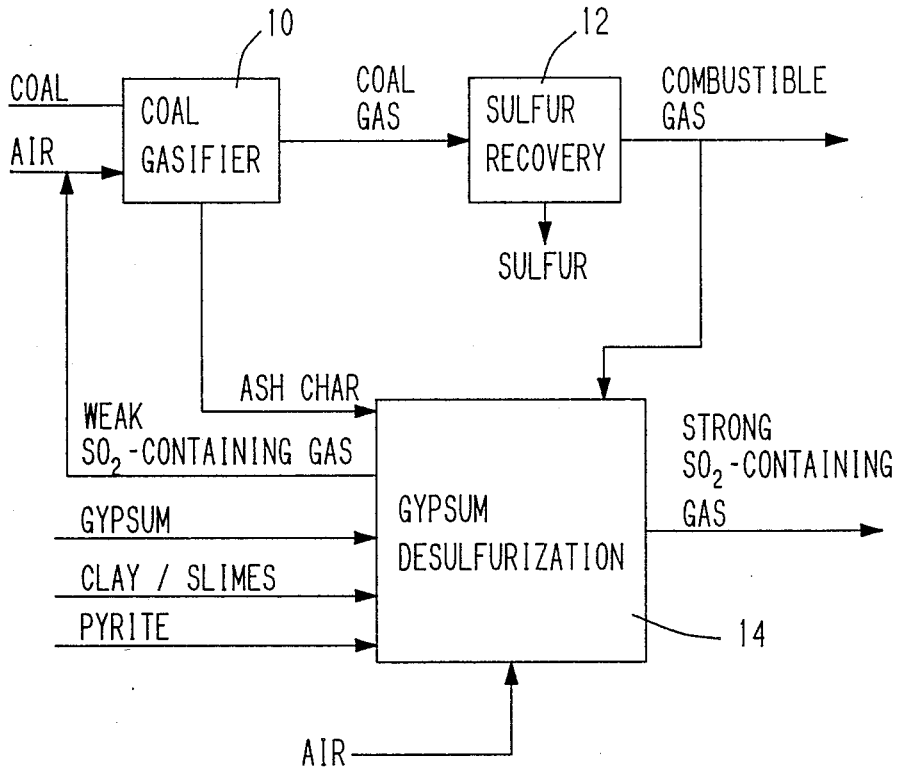
FIG. 1 is a schematic diagram of the principal features of a process of this invention for the coproduction of a combustible first gas stream, a weak sulfur-dioxide-containing second gas stream, and a concentrated sulfur-dioxide-containing third gas stream.

FIG. 1 illustrates the principal features of the process of this invention. Coal is fed into a coal gasifier 10 where the coal is heated in the presence of an oxygen-lean atmosphere under partial coal-gasifying conditions to produce a carbonaceous char and a crude coal gas stream. The crude coal gas is directed to a sulfur recovery zone 12 where the sulfur-containing compounds are separated from the crude coal gas to produce a combustible gas stream and elemental sulfur. The carbonaceous char from the coal gasifier 10 is fed into the gypsum reactor 14 along with gypsum and other optional materials, such as pyritic materials and clay/slimes. A weaker sulfur-dioxide-containing gas stream is produced in the early stages of the gypsum reactor, and a concentrated sulfur-dioxide-containing gas stream is produced from the later stages of the gypsum desulfurization reactor. The concentration of $SO_2$ in the weaker $SO_2$-containing gas stream is preferably less than about 7%. A preferred concentration is between about 4% and 5%. A typical weak $SO_2$-containing gas stream contains (on a wet mole % basis) $CO_2$, 7.5%; $N_2$, 69.1%; $O_2$, 9.7%; $SO_2$, 1–7%; $H_2O$, 13.0–7.0%. The early stages producing the weaker $So_2$ gas stream includes the ignition, drying and early gasification stages of the gypsum desulfurization process. The $SO_2$ content of the weaker $SO_2$-containing gas stream is selected by selecting the dwell time of the reactants in the early stages or the endpoint of the windbox from which the weaker $SO_2$ gas stream is withdrawn. The strong $SO_2$ gas stream contains a higher percentage of $SO_2$ and is usable as a feedstock for the production of sulfuric acid. The concentration of $SO_2$ in this gas stream is preferably greater than about 8%. In a typical strong $SO_2$-containing gas stream, the components (on a dry mole percent basis) may be as follows $CO_2$, 10.7%; $N_2$, 73.4%; $0_2$, 7.2%; $SO_2$, 8.7%.

As noted above, the first step of the process of this invention involves the partial gasification of a coal feedstock to produce a carbonaceous char and a crude gas stream. Unlike conventional coal gasification operations in which substantially complete gasification of the carbonaceous component of the coal is sought, in the present process the coal is heated under partial gasifying conditions so as to leave a substantial portion of the carbon as a carbonaceous char. The partial gasifying conditions are achieved primarily by conducting the gasification in an oxygen-lean atmosphere at a lower temperature than is employed in conventional coal gasification operations. The gasification temperature is a function of the flow rate and oxygen content of the gas fed into the gasifier, the nature of the coal (i.e., BTU content), and the residence time of the coal in the gasifier.

The partial gasifying conditions generally include an oxygen-lean atmosphere and a temperature of from about 700°C. to about 1100°C. Substantially lower temperatures may not achieve adequate gasification or volatilization of the sulfur components of the coal, whereas higher temperatures may result in excess gasification or difficulties in controlling the rate of gasification. The coal-gasifying conditions preferably include a temperature of from about 750°C. to about 1000°C.

As used herein, the term "oxygen-lean atmosphere" indicates that, during the time the coal is in the gasifier, insufficient oxygen or equivalent provided by an $SO_2$-containing gas stream is supplied to the coal to cause essentially complete reaction of the volatile carbon compounds. Thus, both the flow rate and oxygen content of the gas supplied to the coal gasifier can be varied to control the degree of combustion. Advantageously, the amount of oxygen supplied to the gasifier is sufficient to convert complex volatile carbon compounds to simple combustible gases, such as carbon monoxide, methane and hydrogen.

The oxygen-lean atmosphere is advantageously provided by air mixed with the weaker $SO_2$ stream obtained from the initial gypsum desulfurization stages, although it also can be provided by the addition of air alone. The weaker sulfur-dioxide-containing second gas stream and air serve as oxidants in the gasification step. The weaker $SO_2$ is recycled directly back to the coal gasification zone by a gasifier compressor. The oxidizing potential of the $SO_2$ replaces an equivalent amount of oxidizing potential which would otherwise be supplied by air. The ratio of $SO_2$-containing gas to air is generally from about 10:1 to 11:1. In one specific embodiment, the flow of the sulfur-dioxide-containing second gas stream to the coal gasifier is generally at a rate of about 397,200 lbs/hr. while the air required as extra input flows generally at a rate of about 41,000 lbs/hr. The flow rate of the air is controlled to obtain the desired gasification temperature. The $SO_2$ is reduced to $H_2S$ and COS in the coal-gasifying zone, which is removed at later stages of the process of this invention.

As seen from FIG. 1, the process of this invention results in greater elemental sulfur recovery since the weaker $SO_2$ stream is recycled to the coal gasifier, and less sulfuric acid is produced since only a portion of the $SO_2$ produced in the gypsum desulfurization reactor is converted into sulfuric acid. At the same time, the need for feeding air into the coal gasification zone is reduced, since the second stream containing weaker $SO_2$ is mixed with the air to provide the oxygen-lean atmosphere required to carry out the partial coal gasification step properly.

Figure 2:
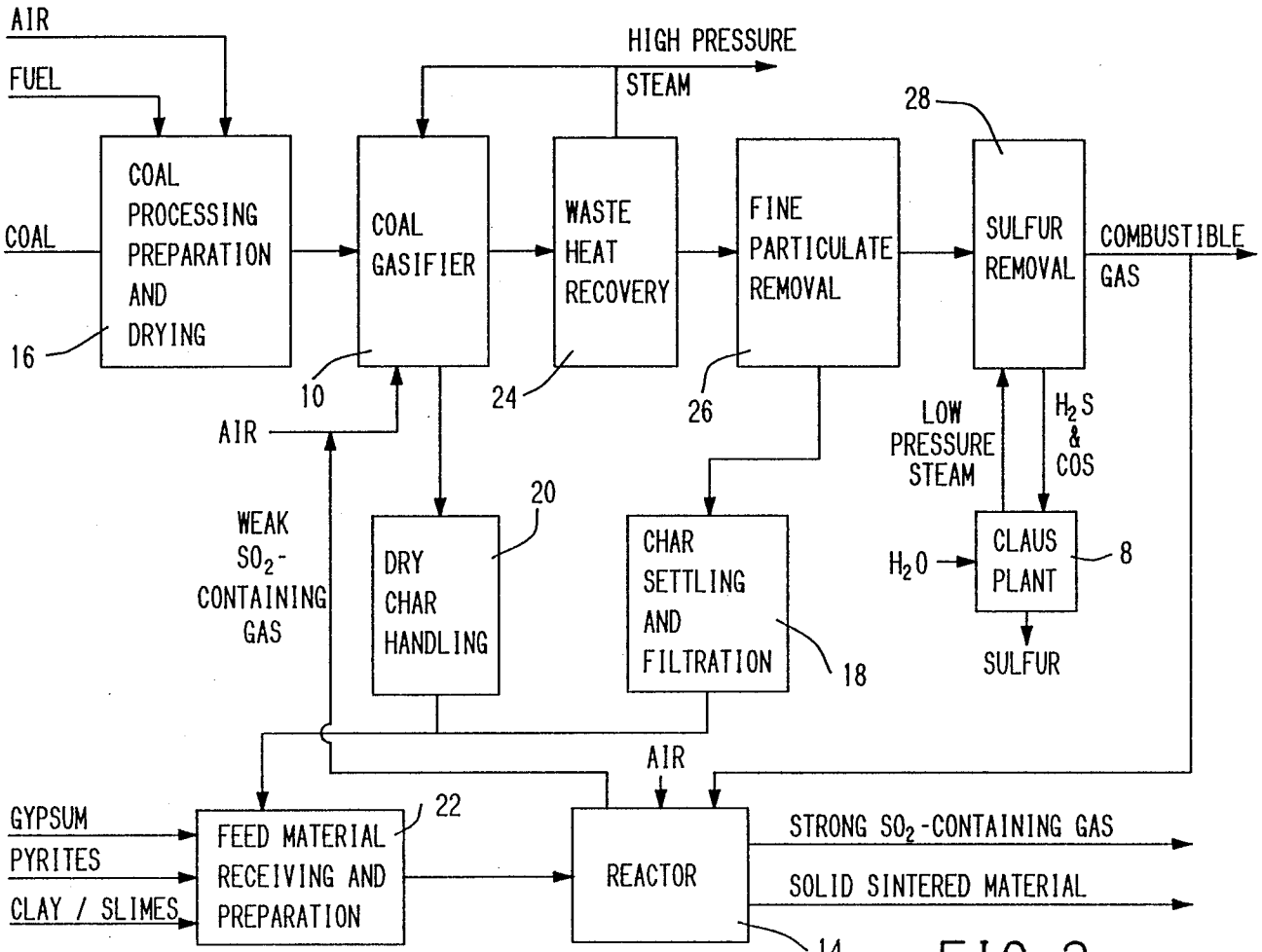
FIG. 2 is a schematic diagram of an embodiment of a process for the coproduction of a combustible gas, a weak sulfur-dioxide-containing second gas stream, and a concentrated sulfur-dioxide-containing third gas stream.

FIG. 2 illustrates a preferred embodiment of the process in greater detail. Coal, air and fuel are fed into the coal processing and drying zone 16 where the coal is dried and comminuted. The processed coal is directed into the coal gasifier 10. The coal is heated in the gasifier 10 in the presence of an oxygen-lean atmosphere under partial coal-gasifying conditions to produce a carbonaceous char and a crude coal gas stream.

In one embodiment of the invention, steam also is introduced into the coal gasifier. Advantageously, waste heat is recovered from the crude gas stream in a waste heat boiler, which is used as a source of steam for the gasifier. It is well-known to use steam as a reactant in coal gasification processes. The steam provides a source of hydrogen, resulting in a gas richer in hydrogen. Moreover, steam acts as a quench and thus provides an additional means for controlling the temperature. When steam is employed in the gasification step, the amount is controlled, in combination with the amount of oxygen, to achieve a desired gasifier exit temperature.

One advantage of this process is that the coal which is fed to the gasifier may be of varying quality, and one may readily switch from one grade of coal to another.

Typical coals include lignite, subituminous, bituminous and the like. Preferably, the coal has a high sulfur content which further adds to the efficiency of the present invention due to its lower price and contribution of additional sulfur to the product sulfur-containing gases.

Conventional coal gasification equipment may be used, provided that it has means for controlling operating parameters so as to achieve partial gasifying conditions. Examples of suitable gasification equipment are fixed and fluid bed reactors. One example of a fluidized bed gasifier that is preferred is the so-called "Winkler gasifier," which is described in U.S. Pat. No. 4,017,272, incorporated herein by reference. Another more preferred gasifier that can economically handle large volumes of gas and convert coal to gas without liquid by-products with minimal environmental damage is the U-Gas process described by Patel in *The Oil and Gas Journal,* 8/1/77; p. 51–54. The U-Gas gasifier, using an ash-agglomeration technique, enables the gasifier to achieve carbon-to-gas conversion efficiencies as high as slagging types of fixed-bed and entrained-types reactors. Reducing conditions are always present in the fluidized bed causing nearly all of the sulfur present in the feed coal to be converted to hydrogen sulfide.

The reaction in the gasifier is advantageously conducted under super atmospheric pressures, generally above 1.5, for instance from about 1.5 to 20, advantageously from about 2 or 2.5 to 15, and preferably from about 6 to 14, atmospheres absolute. The selection of the super atmospheric pressure which may be employed in a given plant depends on the design and pressure tolerance of the processing equipment, the pressure drop provided by the equipment downstream of the gasifier, the particular use desired for the product gas, whether multiple gasifiers are used in trains, and the like. The use of the higher reaction pressures increases the throughput of the gasifier.

When a fluidized bed type gasifier is used, the fluidizing medium advantageously is steam, which also serves as a reactant. It can alternatively be air, carbon dioxide or recycle gas, or mixtures thereof, each with or without steam. Steam is particularly attractive as a fluidizing medium, and may also be used as a diluent gas for the gasifying medium, in that it can be condensed and easily separated from the crude gas stream, leaving a higher heat value product gas.

The coal should only have a residence time within the oxygen-lean atmosphere in the gasifier sufficient to produce a gaseous effluent and the desired carbonaceous char. Preferably, the carbonaceous char will contain from about 40 to about 80% by weight carbon. The optimum residence time may vary widely and is a function of the gasifier temperature, the oxygen content and flow rate of the oxygen-lean atmosphere, the coal quality, particle size, and reactivity (e.g., the porosity, volatiles content), and the like. For a particular reaction condition, the optimum residence time may be readily determined empirically.

In one embodiment of the present process, the coal gasification step is conducted in a pressurized, fluidized bed gasifier, with steam and the oxygen-lean atmosphere introduced at spatially-separate points, substantially uniformly distributed circumferentially, at different levels in the gasifier and in amounts sufficient to substantially contact and gasify a portion of the constituents of the fluidized bed under controlled selective reaction conditions. The details of such procedure are taught in the above-mentioned U.S. Pat. No. 4,017,272, incorporated herein by reference.

The gasifier produces carbonaceous char and a crude coal gas stream containing various amounts of nitrogen, carbon monoxide, carbon dioxide, hydrogen, hydrogen sulfide, carbon sulfide and methane. The amount of methane produced may be influenced by the operating conditions of the gasifier.

As shown in FIG. 2, the char produced in the gasifier is fed to a dry char handling zone 20 for later delivery to the gypsum feed material preparation area 22. The crude coal gas stream is directed to a waste heat recovery zone 24 where it is cooled and high pressure steam is produced. The crude gas stream, cooled to less than about 100°C., which typically contains particulate materials including char and ash, is fed into a fine particulate removal zone 26 where residual amounts of the particulates are removed and discharged to char settling and filtration zone 18 for combination with the gypsum feed material. The particulates also can be recycled to the gasifier. An example of a suitable particulate removal zone is a dry cyclone. The crude coal gas stream is passed to the sulfur-removal zone 28 where the sulfur-containing compounds are separated from the crude coal gas stream to produce an environmentally acceptable combustible gas stream.

After the particulates have been removed from the crude coal gas stream, the sulfur-containing compounds are separated from the crude gas stream and converted into sulfur or sulfur-containing compounds. Sulfur recovery processes are well-known, and any of variety of such processes may be employed for the sulfur-removing step of the present process. Hydrogen sulfide and carbonyl sulfide present in the crude gas stream may be removed using any suitable regenerable acid gas removal process. Preferred processes include Selexol process, disclosed in U.S. Pat. No. 2,649,166, and the methyldiethanolamine (MDEA) process. The sulfur-containing materials include $H_2S$ and COS produced in the coal gasification zone by the reduction of $SO_2$. The acid gases removed from the crude coal gas are passed to a conventional Claus Process for conversion to sulfur. Water is fed into the Claus plant 8 with the acid gases and low pressure steam is generated in the Claus plant which may be used to provide energy for the sulfur removal zone. The effluent from the sulfur-recovery step is a clean-burning, low-BTU combustible gas stream which is used advantageously as an energy source for both internal requirements and export. For example, a portion of the combustible gas can be burned to produce steam which, in turn can be used to generate electrical power. Alternatively, this combustible gas stream portion can be used as a power gas, i.e., a fuel for a gas turbine. The remaining portion of the combustible gas stream is used as a fuel to heat the gypsum desulfurization reactor 14.

In addition to the crude coal gas stream, a carbonaceous char is produced in the gasifier. Since there has been some oxidation of the carbon in the coal to form the crude coal gas stream, there will be some increase of the ash content in the product char on a weight basis. Upon removal from the gasifier, the char is passed to a dry char handling zone 20.

In the gypsum feed preparation zone 22, gypsum and char from the dry char handling zone 20 are combined to form a feed mixture. Other materials may be added to the feed mixture including clays, phosphatic slimes and pyritic materials. The feed mixture is fed into the gypsum reactor 14 along with air and heated to reduce substantially all of the sulfur in the feed mixture to gaseous compounds of sulfur in a +4 or lower oxidation state. Upon heating under reducing conditions the gypsum desulfurization reactor 14 produces a solid sintered material and sulfur-containing gases, one containing strong $SO_2$: and one containing a weaker $SO_2$:. The weaker $SO_2$: stream is recycled back to the coal gasifier 10.

The proportions of char, gypsum and other components are such that the non-gypsum portion of the feed mixture contains sufficient reducing potential to reduce a substantial portion, preferably substantially all, of the sulfur in the gypsum to gaseous compounds of sulfur in a +4 or lower oxidation state. While the weight percentage of the char to the overall weight of the total feed mixture may vary, the char is generally employed in amounts to provide a carbon content ranging from about 3 to about 11% by weight of the total feed mixture on a dry weight basis. Preferably, the weight percent of carbon is from about 4 to about 9 percent by weight. (Although it may be advantageous to use such a feed mix, the process of this invention may be carried out by delivering the components for the gypsum desulfurization reaction directly to the gypsum desulfurization zone.)

Both natural and by-product gypsums, such as those which originate from the production of phosphoric acid and which are commonly known as phosphogypsum, can be used in the mixture. The particle size of the gypsum may generally range from about 20 mesh to 500 mesh and contain from 60 to 95% $CaSO_4$ in the form of crystals. While the amount of gypsum in the mixture can vary, the gypsum is generally present in amounts from about 50 to about 80 percent by weight of the overall mixture on a dry weight basis. Preferably, the gypsum is present in amounts ranging from about 55 to about 75 percent by weight of the feed mixture.

In a preferred embodiment and; in accordance with the teachings of U.S. serial no. 927,439 filed Nov. 6, 1986, now abandoned, incorporated by reference, a combination of gypsum, pyrite and carbonaceous material, which in the present case can be char, may be used as a feed mix for the gypsum desulfurization reactor. In addition to pyrite, other iron and sulfur-containing minerals may be used, all of which are referred to herein collectively as "pyritic materials." Such pyritic materials include, for example, pyrite, metallic iron, elemental sulfur, iron oxide, iron (II) sulfide, and combinations thereof. As taught in the above-cited application, the combination of pyrite and carbonaceous material significantly improves the physical quality of the solid sintered by-product and increases the sulfur level of the gaseous effluent which is produced in the gypsum desulfurization reactor. In addition, the sulfur removal efficiency of the overall process is improved while addressing the ecological need for a clean and efficient method of disposal for pyritic materials. The amount of pyritic material added to the feed mix may vary considerably depending on the amount of char and other sulfur compounds added to the mix and the amount of ash contributed by the char. In general, the pyritic material may be present in amounts ranging from about 0 to about 20 percent by weight of the total feed mixture on a dry weight basis. Preferably, the weight percent of the pyritic material is from about 5 to about 15 percent of the feed mixture.

Optional additives may be incorporated into the feed mixture. Examples of such additives include clay (e.g., clay slime tailings resulting from the benefication of phosphate rock), recycled sintered material (also known as returns), and binding agents such as lime. The preferred additive is clay. The non-return additives clay and binding agents, may be present in amounts from 0 to 5 percent by weight of the feed mixture on a dry weight basis with amounts of from 1 to about 2 percent by weight being preferred. Recycled sintered material or returns may be present in the feed mix in greater amounts ranging from about 5 to 25 percent by weight of the feed on a dry weight basis with amounts of from 10 to about 20 percent by weight being preferred.

The gypsum desulfurization step involves heating the feed mixture or components delivered to the gypsum desulfurization zone in a reaction zone under reducing conditions advantageously at a temperature sufficiently high to cause thermal degradation of gypsum and to effect reduction of sulfur compounds to gaseous sulfur compounds in the +4 or lower oxidation state. The reaction temperature of the feed mixture generally ranges from about 1100°C. to about 1500°C., preferably from about 1200°C to about 1300°C. The temperature can be advantageously initiated by burning combustible gas resulting from the coal gasification and sulfur removal operations in the reaction zone. The feed mixture can be dried by burning a portion of the combustible gas to produce a hot spent combustion gas and passing the hot spent combustion gases through the feed mixture. Additional air then can be introduced into the reactor in an amount sufficient to generate sufficient heat to support the endothermic gypsum-reduction reactions, yet still maintain reducing conditions. As used herein, the term "reducing conditions" means that the overall conditions in the reaction zone favor reduction of the gypsum compounds. Although both oxidation and reduction reactions take place in the reaction zone, the reducing conditions permit the formation of gaseous sulfur compounds.

Various types of reactors may be used to provide the reaction zone to heat the gypsum-containing feed mixture. A particularly preferred reactor is a circular travelling grate, such as that employed in the Gardner et al. process described above.

Figure 3:
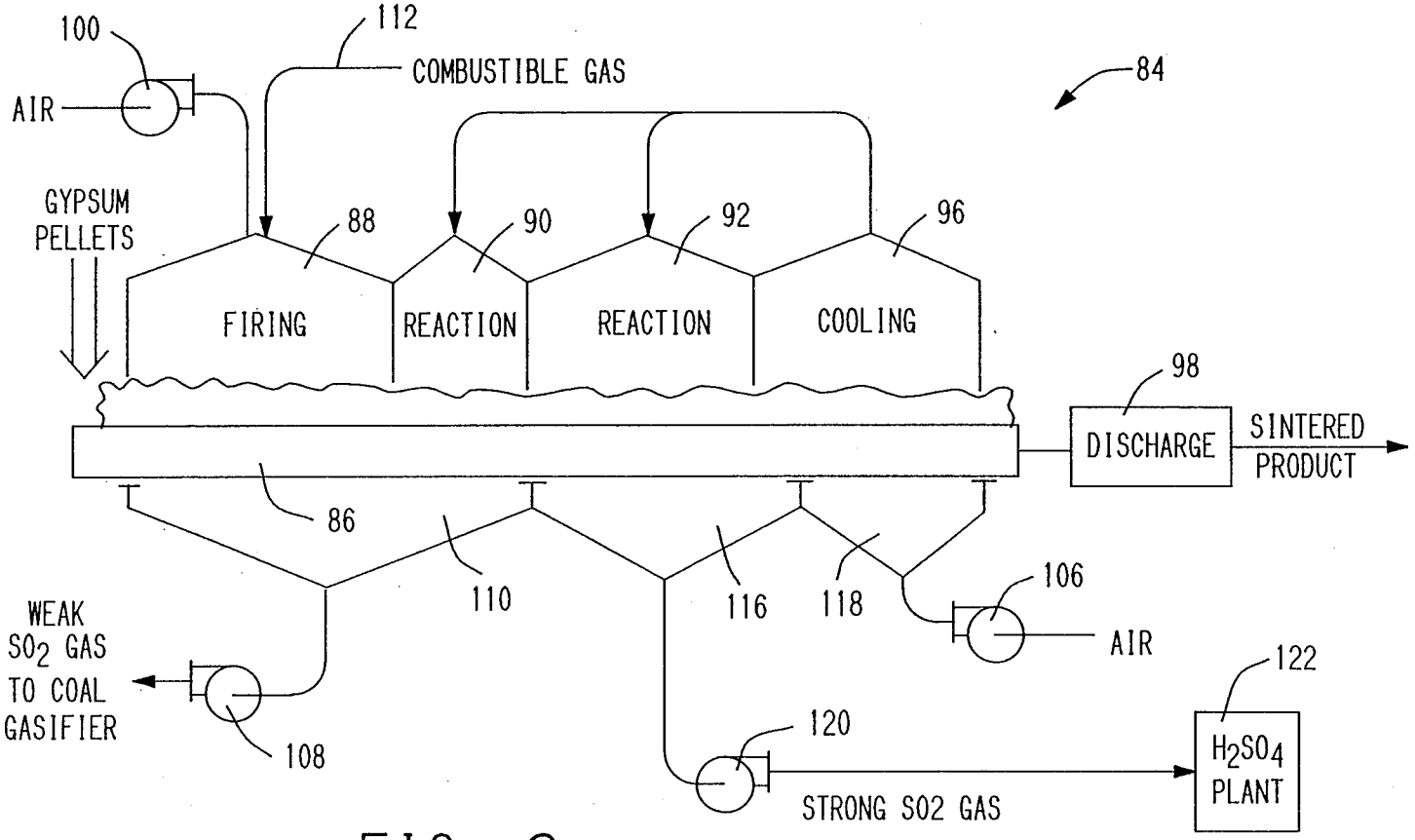
FIG. 3 is a schematic diagram of an embodiment of a travelling grate reactor suitable for use in the present invention.

An example of a suitable circular travelling grate mechanism for use in an embodiment of the invention is illustrated in FIG. 3. The mechanism 84 includes facilities (not shown) for depositing a charge of green pellets upon a moving grate 86 which successively moves the charge through various zones, such as firing zone 88, reaction (sintering) zones 90 and 92, and cooling zone 96, within a sealed hood to a facility 98 for discharging solids from the travelling grate. The charge preferably may be retained in the post-firing zones for a period of from about 10 to about 30 minutes. Blower 106 drives air through windbox 118 and the hot charge on the grate in cooling zone 96. Line 112 supplies combustible gas from the coal gasifier 10 and sulfur removal (12, FIG. 1) to the firing zone 88 sufficient to heat the surface of the charge to a temperature within the range of 1100°C. to 1550°C. Quantities of fresh air from the blower 100 are supplied to the firing zone 88 to provide oxygen for combustion of the combustible gas. A portion of the product gas is removed from the firing zone 88 and initial reaction zone 90 through the wind box 110 and is fed to recycle compressor 108 for recycling to the coal gasification zone. This portion of the product gas is the weaker $SO_2$-containing second gas stream. The remaining product gas, which contains concentrated $SO_2$ is removed from the reaction zone 92 via wind box 116 and then may be passed via blower 120 to any suitable conventional sulfuric acid plant 122. An example of a suitable plant is available from Davy McKee, Lakeland, Fla. 33807, U.S.A., which employs the Davy Double Absorption Catalytic process to convert sulfur dioxide to sulfuric acid. The concentrated $SO_2$-containing product gas optionally may be passed through an incinerator where combustible gas products are burned. Heat from this process may be recovered by the use of heat exchangers before the product gas is passed on to a sulfuric acid plant.

When a circular travelling grate reactor is used, it is preferred that the feed mixture be formed into pellets. Such pellets may occur in a variety of shapes, such as balls, nodules, cylindrical pellets, etc. For proper pelletizing, at least a portion of the mixture is preferably relatively fine. The pelletizing can be accomplished in an open circuit balling pan or drum arrangement or a closed circuit balling pan or drum arrangement with sizing devices such as vibrating screens or roller separators. Preferably, the pelletizing operation produces balls or green pellets about 1 inch (25.4 mm) or less in diameter. One example of a suitable pelletizing pan apparatus is illustrated in U.S. Pat. No. 3,169,269. Water and/or other ingredients may be added to the mixture being pelletized to aid in forming green pellets.

In a preferred embodiment, the travelling grate mechanism includes sealed hoods and burners for heating the pellets under controlled reaction conditions to evolve sulfur and/or sulfur dioxide. One example of a preferred travelling grate mechanism is a liquid sealed circular grate (Carousel type) similar to the circular travelling grates commercially available from Davy McKee Corporation, Lakeland, Fl., 33807, U.S.A., having a size sufficient to handle large quantities of pellets economically. Travelling grates that may be used in the present process are also disclosed in U.S. Pat. Nos. 3,302,936; 3,325,395; 4,111,755; 4,200,517; and 4,220,454 which are incorporated by reference in their entireties.

The following example represents a computer simulation of the process of the present invention.

EXAMPLE

This example illustrates the process of this invention using 202,583 lbs per hour of bituminous coal containing 5% moisture which is charged to a U-gas type coal gasifier. Air is introduced to the fluidized bed gasifier at a feed rate of 41,743 lbs per hour and steam at a feed rate of 44,674 lbs per hour at 150 psig. An $SO_2$-containing gas stream to be used as a source of oxidant is introduced into the gasifier at a feed rate of 397,293 lbs/hr (wet basis). The temperature of the gasifier is controlled at about 1000°C. Char is discharged from the gasifier at a rate of 58,988 lbs per hour. The char is transferred to a dry char handling zone. The remaining gasifier products are passed to a waste heat recovery zone where the products are cooled and fine char removed at a rate of 20,260 lbs per hour. The fine char is transferred to the dry char handling zone. The crude gas stream is then directed to a fine particulate removal zone where a char slurry is removed from the crude gas stream at a rate of 2026 lbs per hour (dry basis). The fine char, char slurry and bottom char from the gasifier are combined and directed to the feed mixture preparation zone for the gypsum reactor at a feed rate of 81,274 lbs per hour (dry basis).

The cooled crude gas stream is passed to a sulfur removal zone where the sulfur-containing compounds are removed and converted to elemental sulfur. The product combustible gas is produced at a rate in excess of 393,683 lbs per hour.

A feed mixture is continuously prepared for the gypsum reactor in a balling mechanism which forms the mixture into pellets suitable for charging into a travelling grate reactor. The various components are introduced to the balling mechanism at a feed rate of 81,274 lbs per hour of char, 460,415 lbs per hour of raw gypsum (plus 62,784 lbs per hour of moisture), 78,271 lbs per hour of pyrites (plus 7827 lbs per hour of moisture), 7663 lbs per hour of clay slimes (plus 12,583 lbs per hour of moisture), and 156,821 lbs per hour of returns.

The pelletized feed mixture is heated on a rotary grate fueled by a portion of product combustible gas at a feed rate of 16,780 lbs per hour. The rotary grate produces 315,000 lbs per hour of solid sintered material, 910,680 lbs per hour (dry basis) of a strong sulfur dioxide-containing gas and 397,293 lbs per hour (wet basis) of a weak sulfur-dioxide-containing gas. The strong sulfur-dioxide-containing gas on a dry basis is 10.7 mol % of carbon dioxide, 73.4 mol % of nitrogen, 7.2 mol % of oxygen, and 8.7 mol % of sulfur dioxide. The weaker $SO_2$-containing gas on a wet basis is 8.3 mol % of CO, 68.0 mol % of $N_2$, 8.4 mol % $O_2$, 6.7 mol % $SO_2$and 8.6 mol % of $H_2O$.

While the present invention has been described with reference to particular embodiments thereof, it will be understood that numerous modifications may be made by those skilled in the art without actually departing from the spirit and scope of the invention as defined in the appended claims:

I claim:

1. A process for the coproduction of a combustible first gas stream usable as an energy source, a sulfur-dioxide-containing second gas stream usable as a source for oxidant in the gasification of coal and a sulfur-dioxide-containing third gas stream usable as a feedstock for the production of sulfuric acid, said process comprising the steps of:

(a) reacting coal in a coal gasification zone in the presence of an oxidant under partial coal-gasifying conditions to produce carbonaceous char and a crude gas stream;

(b) separating sulfur-containing compounds from the crude gas stream in a sulfur recovery zone to produce a combustible first gas stream and elemental sulfur;

(c) reacting said carbonaceous char and gypsum in a reaction zone in proportions such that the non-gypsum portion of the carbonaceous char and gypsum mixture contains sufficient reducing potential to reduce sulfur in the gypsum to gaseous compounds of sulfur in a +4or lower oxidation state under reducing conditions to produce first a sulfur-dioxide-containing second gas stream which contains weaker $SO_2$ produced in an early stage of the reaction zone and removed from said reaction zone, and then a sulfur-dioxide-containing third gas stream which contains concentrated $SO_2$ recovered from a later stage of the reaction zone.

2. The process of claim 1, wherein step (a) comprises heating coil in the presence of an oxidant which contains up to about 50% by volume of steam, wherein the oxygen content and the feed rate of the oxidant are controlled to maintain a temperature of from about 700°C. to about 1100°C.

3. The process of claim 2, wherein the feed the feed rate of the oxidant is controlled to maintain a temperature of from about 700°C. to about 1000°C.

4. The process of claim 3, wherein the partial coal-gasifying conditions include a pressure of from about 1.5 to about 20 atmospheres.

5. The process of claim 1, wherein the partial coal-gasifying conditions of step (a) are controlled to produce a solid carbonaceous char which contains from about 40 to about 80% by weight carbon.

6. The process of claim 1, wherein the carbonaceous char and gypsum of step (c) are combined to form a feed mixture.

7. The process of claim 6 wherein the feed mixture is pelletized prior to being subjected to said reaction in said reaction zone.

8. The process of claim 1, wherein pyritic material is combined with the carbonaceous char and the gypsum.

9. The process of claim 8, wherein the pyritic material is pyrite, metallic iron, elemental sulfur, iron oxide or iron (II) sulfide.

10. The process of claim 9, wherein the pyritic material is pyrite and is added to the feed mixture at a concentration of from about 0 to about 20% by weight.

11. The process of 1, 4 or 8, wherein the carbonaceous char and gypsum of step 9*c*) contains from about 50 to about 80% by weight gypsum; a sufficient amount of the carbonaceous char to provide a carbon concentration in the carbonaceous char and gypsum of from about 3 to about 11% by weight; and from about 0 to about 20% by weight pyritic material.

12. The process of claim 11 wherein the carbonaceous char, gypsum and pyritic material are combined to form a feed mixture.

13. The process of claim 12, wherein the feed mixture of step (c) is formed into pellets having an average diameter of from about 1 inch or less.

14. The process of claim 1, wherein prior to the reacting step of (c), the carbonaceous char and gypsum is heated.

15. The process of claim 1 wherein at least a portion of the combustible first gas stream is used as a fuel for producing steam and the steam is directed to the coal gasification zone of step (a).

16. The process of claim 14, wherein the reacting of the carbonaceous char and gypsum of step (c) is achieved by passing a mixture of air and a combustible gas selected from the group consisting of the crude gas stream from step (a), the combustible first gas stream from step (b) and mixtures thereof through said carbonaceous char and gypsum, wherein the flow ratios of the air and the combustible gas are controlled to maintain a temperature sufficiently high to cause thermal decomposition and reduction of the gypsum, and to maintain reducing conditions within the carbonaceous char and gypsum.

17. The process of claim 16, wherein the combustible gas used for heating the carbonaceous char and gypsum is the combustible first gas stream from step (b) and the flow rates of the air and the combustible first gas stream are controlled to maintain a temperature of the feed mixture of from about 1100°C. to about 1500°C.

18. The process of claim 1, wherein the flow rates of the air and the combustible first gas stream are controlled to maintain a temperature of from about 1200°C. to about 1300°C.

19. The process of claim 1, wherein the reacting of step (c) is conducted in a travelling grate reactor.

20. The process of claim 22, wherein step (c) includes moving the travelling grate carrying a charge of pelletized feed mixture successively through firing and post-firing zones, and the charge is retained in the post-firing zone for a period of from about 10 to about 30 minutes.

21. The process of claim 1, wherein the sulfur-dioxide-containing third gas stream is passed to a sulfuric acid plant.

22. The process of claim 1, wherein the coal is lignite, subituminous or bituminous.

23. The process of claim 22, wherein the coal contains sulfur.

24. The process of claim 1 or 8, wherein the carbonaceous char and gypsum additionally contains clay, lime, recycled solid sintered material or mixture thereof.

25. The process of claim 11, wherein the feed mixture comprises on a dry weight basis, (a) from about 55 to about 75 percent by weight of gypsum;
(b) from about 4 to about 9 percent by weight of char as carbon;
(c) from about 5 to about 15 percent by weight of pyritic material
(d) from about 0 to about 5 percent by weight of clay, lime or mixtures thereof; and
(e) from about 5 to about 25 percent by weight of recycled solid sintered material.

26. The process of claim 24, wherein the clay, lime or mixtures thereof is present in amounts of from about 1 to 2 percent by weight.

27. The process of claim 24, wherein the recycled sintered material is present in amounts of from about 10 to 20 percent by weight.

28. The process of claim 1, wherein the concentration of the sulfur dioxide in the sulfur-dioxide-containing third gas stream is greater than 8%.

29. The process of claim 1, wherein the concentration of the sulfur dioxide in the sulfur-dioxide-containing second gas stream is less than 7%.

30. The process of claim 29, wherein the concentration of the sulfur-dioxide-containing second gas stream is between about 4–5%

31. The process of claim 1, where the sulfur-dioxide containing second gas stream which contains weaker $SO_2$ is recycled to the coal gasification zone to provide a source of oxidant in the gasification of coal.

* * * * *

UNITED STATES PATENT AND TRADEMARK OFFICE

CERTIFICATE OF CORRECTION

PATENT NO. : 4,963,513

DATED : October 16, 1990

INVENTOR(S) : Jerome H. Marten

It is certified that error appears in the above-identified patent and that said Letters Patent is hereby corrected as shown below:

Cover page, in the Abstract, fifth line from bottom, "statge" should be --stage--;

same line, after "reaction" insert a comma --,--;
last line, "th eoxidant" should be --the oxidant--.

Column 1, line 33, after "entirety" insert a period --.--.

Column 2, line 14, after "mixture" insert a period --.--.

Column 7, line 40, after "and" delete the semicolon ";";
line 42, before "incorporated" insert --which is--.

Column 10, line 28, "CO" should be --$CO_2$--;
line 29, "$SO_2$and" should be --$SO_2$ and--;
line 58, "+4or" should be --+4 or--.

Column 11, line 4, delete "the feed" (second occurrence);
line 28, after "of" insert --claims--;
line 29, "9c)" should be --(c)--.

UNITED STATES PATENT AND TRADEMARK OFFICE

CERTIFICATE OF CORRECTION

PATENT NO. : 4,963,513

DATED : October 16, 1990

INVENTOR(S) : Jerome H. Marten

It is certified that error appears in the above-identified patent and that said Letters Patent is hereby corrected as shown below:

Column 12, line 7, "claim 1" should be --claim 17--;
line 13, "claim 22" should be --claim 19--;
line 35, after "material" insert a semicolon --;--.

Signed and Sealed this

Twentieth Day of October, 1992

*Attest:*

DOUGLAS B. COMER

*Attesting Officer*

*Acting Commissioner of Patents and Trademarks*